United States Patent [19]

Wodnicki et al.

[11] Patent Number: 4,701,581

[45] Date of Patent: Oct. 20, 1987

[54] HOUSING INCLUDING A TEST BUTTON SECURED THERETO WITH A LIVING HINGE

[75] Inventors: Glen G. Wodnicki, Sterling Heights; Carl Czarnecki, Dearborn Heights, both of Mich.

[73] Assignee: United Technologies Automotive, Inc., Dearborn, Mich.

[21] Appl. No.: 907,337

[22] Filed: Sep. 15, 1986

[51] Int. Cl.[4] ..... H01H 9/02

[52] U.S. Cl. ..... 200/52 R; 200/159 R; 200/293; 200/317

[58] Field of Search ..... 200/303, 304, 302.2, 200/340, 314, 159 R, 293, 297, 61.58 R, 52 R, DIG. 25, 159 A, 159 R, 317; 361/401

[56] References Cited

U.S. PATENT DOCUMENTS 3,412,225 11/1968 Rogers et al. ..... 200/67 R 4,055,734 10/1977 Hayden ..... 200/5 A 4,360,722 11/1982 Georgopulos ..... 200/340

*Primary Examiner*—A. D. Pellinen

*Assistant Examiner*—Morris Ginsburg

*Attorney, Agent, or Firm*—Robert P. Hayter

[57] ABSTRACT

A housing in which electrical components may be mounted. The housing is formed from a single integral molded part which includes a living hinge connecting a base portion and a cover portion such that the two portions may be secured to each other to define the housing. A test button extension is likewise secured to the housing via a living hinge such that the test button extension may be rotated to provide a test button assembly which is appropriately positioned such that the test button extends through an opening in the housing and may be manually displaced to engage an electrical component within the housing to perform an appropriate test function.

12 Claims, 5 Drawing Figures

FIG. 1
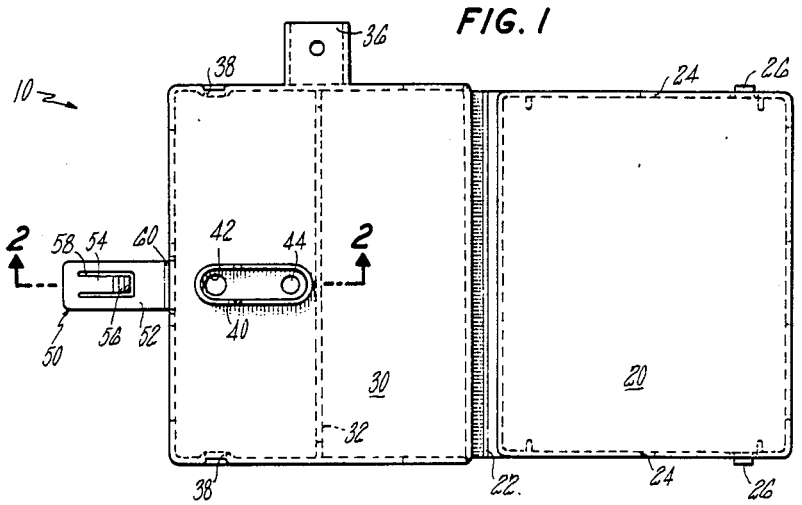
FIG. 2
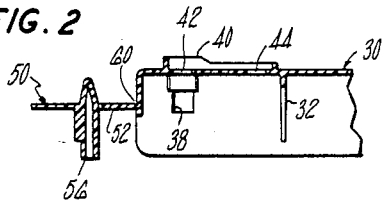
FIG. 5
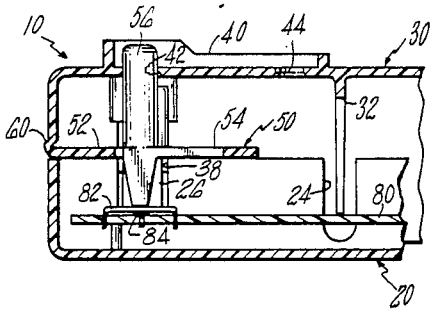
FIG. 3
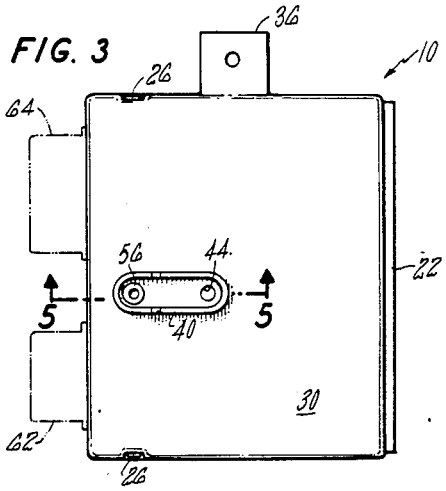
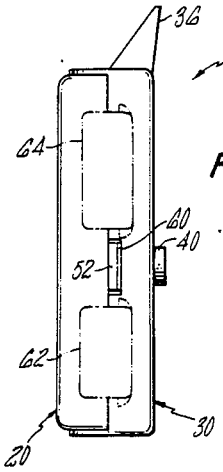
FIG. 4

HOUSING INCLUDING A TEST BUTTON SECURED THERETO WITH A LIVING HINGE

BACKGROUND OF THE INVENTION

This invention relates to a test button secured to a housing with a living hinge such that the housing and test button may be formed integrally from a single, molded member. More particularly, the herein invention concerns a housing formed from a cover portion and a base portion which are connected by a living hinge and are integrally molded and wherein a test button assembly is likewise integrally molded to the cover portion of the housing and is capable of being rotatably displaced into an interior position of the housing upon assembly such that a housing having a test button located therewithin is provided from a single, molded part.

Housings for containing electrical components are used in many appliances, motor vehicles and the like. The typical housing is designed to shield the electrical componentry from any inadvertent contact, to separate the electrical componentry from other portions of the device to prevent inadvertent electrical connections or damage to the electrical components and is utilized to maintain the electrical components in a safe, clean, moisture-reduced environment. Other safety factors such as fire and the potential for noxious emissions may also be considered. Additionally, by providing all the components in a secure housing appropriate electrical connections may be readily made. If the housing secures electrical components for optional features, such housing may readily be either incorporated or not incorporated within a motor vehicle. Typically, the connectors thereto may be designed to be interconnected if the option is not present in the vehicle or, if the option is present, the electrical componentry and the housing are mounted in the vehicle and the connectors are individually connected thereto.

Test buttons are provided relative to housing such that either upon assembly or for repair or test purposes the test button may be manually actuated to ascertain whether or not the electrical componentry is performing as desired. The test button typically involves the actuation of a switch means such as a clicket switch to provide an electrical input to have the circuit perform a test function. Previous devices have used a rotatably mounted switch actuator mounted to extend through the housing such that upon displacement of one end of the actuator the opposite end is rotatably displaced to engage the appropriate switch means. This type of device although effective is more costly because separate parts are required and because of the necessity of assembling a separate switch actuator to the housing.

The herein described housing and test button is formed from a single integral, molded case which includes appropriate living hinges to allow the parts to be rotatably displaced to the assembled position. The test button is mounted to the test button assembly which is rotated to be within the housing with the test button extending upwardly through an opening in the housing such that it may be manually actuated from the exterior of the housing.

SUMMARY OF THE INVENTION

It is the object of the invention to provide housing assembly.

It is a further object of the invention to provide a improved assembly incorporating an integral test button assembly.

It is yet a further object of the present invention to provide a one-piece, integral housing including a cover portion, a base portion, and a test button assembly.

It is a still further object of the present invention to provide a test button assembly secured by a living hinge to a portion of the housing, said assembly being located within the housing upon assembly and having a test button extending outwardly through an opening in the housing.

A still further object of the present invention is to provide a junction assembly incorporating electrical componentry and a housing to form appropriate electrical junction and switch box to which connections may be made.

It is a yet further object of the present invention to provide a safe, economical, reliable, easy to service and maintain, and easy to assemble housing including a test button.

Other objects will be apparent from the description to follow and the appended claims.

The above objects are achieved according to a preferred embodiment of the present invention by the provision of a housing in which electrical components may be mounted. The housing includes a cover portion, a base portion, means for securing the cover portion to the base portion to define a space therebetween in which components may be mounted, and a test button assembly secured by a living hinge to the cover portion, said test button assembly including a test button secured to a test button extension connected to the living hinge with said test button being within the space defined by the cover portion and the base portion. The cover portion additionally defines an opening through which the test button may be displaced to engage appropriate electrical components. Additionally, the test button may be of sufficient length to extend through the opening and an extending shield may be provided on the cover portion to prevent inadvertent contact with the test button.

Also described is a junction assembly including electrical components, a housing and a test button which includes a cover portion and a base portion which may be secured to eachother to define the housing having a space therebetween in which the electrical components may be secured. A test button assembly is formed integrally with the cover portion and is connected thereto by a living hinge, said test button assembly including a test button being positioned to contact the electrical components when desired.

BRIEF DESCRIPTION OF THE DRAWINGS

FIG. 1 is a top view of an integral molded housing.

FIG. 2 is a sectional view of FIG. 1 taken at line II—II.

FIG. 3 is a top view of the assembled housing.

FIG. 4 is an end view of the assembled housing with the electrical components mounted therein.

FIG. 5 is a partial cutaway sectional view of a portion of FIG. 3 taken at line V—V.

DESCRIPTION OF THE PREFERRED EMBODIMENT

A housing including an integrally formed test buttonis hereinafter described. This housing was designed for specific use as a module for containing electrical componentry for a memory mirror control for a motor vehicle application. It is, of course, to be understood that this housing and the self test button are capable of being used in many applications and are not limited to automotive or appliance type uses.

It is additionally to be understood that although the housing herein is referred to as an integral or molded housing that any means of forming a single piece housing having appropriate living hinges would be an equivalent thereof. Furthermore, a definition of a specific type of switch to be actuated by the test button is, for example, only and is not intended to be limiting in terms of the nature of the invention herein.

Referring now to FIG. 1 there may be seen a top view of an integral molded housing made from polypropylene. The housing 10 includes a base half 20 connected by living hinge 22 to cover half 30 which is connected by living hinge 60 to test button assembly 50.Within base half 20 there may be seen extending catches 26 and slots 24.

Cover half 30 includes flange 36 extending from the side thereof and is used for mounting the housing to its appropriate position in the vehicle or appliance. Rib 32 extends across cover half 30 to provide structural strength and provides a ledge for the receipt of a printed circuit board or similar electrical assembly to be mounted within the housing. Catch openings 38 shown on either side of the cover half are openings in which projecting catches 26 of the base half mayb e engaged to secure the base half to the cover half to define a housing having an opening or space therebetween. Slots 24 from the base half are appropriately positioned such that when the cover half and base half are mated, slots 24 have ribs 32 positoned therein (as also shown in FIG. 5).

Cover half 30 also includes test button opening 42, second opening 44, and shield 40 extending circumferentially about the two openings. Test button opening 42 is provided such that test button 56 from test button assembly may extend therethrough. Second opening 44 is provided for visible inspection of the electrical components such as observation of a light emitting diode or other device to indicate appropriate circuit operation. Shield 40 is provided around the openings and extends upwardly therefrom such that inadvertent contact with the test button is prevented.

Test button extension 52 is connected to the cover half of the housing via living hinge 60. Test button assembly 50 includes test button extension 52 extending from living hinge 60. Extending from test button extension 52 is test button projection 54. Test button projection 54 is separated from test button extension 52 by slot 58 such that test button 56 which is mounted to the end of test button projection is resiliently mounted relative to the test button extension and may be displaced relative thereto.

Referring now to FIG. 2, which is a sectional view of a portion of FIG. 1, it may be seen that cover half 30 defines catch opening 38 and has ribs 32. At the top of the cover half shield 40 may be seen to extend upwardly from the cover such that when the test button is mounted to extend through the test button opening, the shield acts to prevent inadvertent operator contact with the test button. Access to the test button, however, does remain within the extending shield such that the operator may intentionally depress the test button.

Living hinge 60 is shown connecting test button extension 52 to the cover half. Test button 56 is shown mounted to the test button assembly. To place the test button assembly in the fully assembled position relative to the cover half, the test button assembly is rotated about living hinge 60 such that test button 56 extends upwardly through test button opening 42. This entails a simple rotation of the test button assembly into the interior of the housing defined between the cover half and the base half.

FIGS. 3 and 4 show the assembled housing containing appropriate electrical components. FIG. 3 is a top view of the cover half 30 and shows flange 36 extending therefrom and living hinge 22 which secures the integral ends of the cover half and the base half together. Test button 56 may be seen extending upwardly through test button opening 42. Second opening 44 is shown as is shield 40 extending upwardly around both openings. Connectors 62 and 64 are shown extending through the end of the housing and represent the appropriate electrical connections being made to the electrical componentry within the housing which are typically mounted to a printed circuit board.

In FIG. 4, an end view of the assembly of FIG. 3, connectors 62 and 64 are shown extending from the housing. Additionally, base half 20 and cover half 30 are shown assembled together with living hinge 60 connecting the test button extension 52 to the cover half. Shield 40 extending about the opening is seen extending outwardly therefrom.

FIG. 5 is a greatly enlarged view of a portion of the assembled housing including the test button assembly and a printed circuit board assembly. Therein it may be seen that base half 20 and cover 30 define a space therebetween in which test button 56 is secured. Housing 10 is shown to include cover half 30 which has rib 32 extending downwardly to help secure printed circuit board 80 in the appropriate position within the housing. Living hinge 60 connecting test button extension 52 to cover half 30 is shown. The test button assembly has been rotated from the view of FIGS. 1 and 2 such that the assembly is positioned within the housing and test button 56 extends upwardly through test button opening 42. The test button is mounted such that it is capable of being displaced downwardly by operator contact at the end of the test button. When the test button is displaced downwardly, it engages clicket switch 82 and acts to depress the clicket switch downwardly to engage contact 84 making an appropriate electrical contact to commence a test or other type operation. Shield 40, a portion of cover half 30, is shown extending upwardly about test button opening 42 and second opening 44. It may be seen that the shield extends sufficiently upwardly that the inadvertent placement of an object on the cover half of the housing would not engage the test button itself and hence would not cause clicket switch 82 to be closed. Living hinge 60 provides some resiliency which acts to bias the test button to the desired position. Test button projection 54 likewise provides resiliency for returning the test button to its rest position.

The invention has been described herein with reference to a particular embodiment although those skilled in the art will recognize that variations and modifications can be effected within the spirit and scope of the invention.

I claim:

1. A housing in which electrical components may be mounted which comprises:

a cover portion;

a base portion;

means for securing the cover portion to the base portion to define a space therebetween in which components may be mounted;

a test button assembly secured by a living hinge to the cover portion, said test button assembly including a test button secured to a test button extension connected to the living hinge, said test button being partially within the space defined by the cover portion and the base portion; and said cover portion defining an opening through which said test button may be displaced to engage an appropriate component.

2. The apparatus as set forth in claim 1 wherein the test button assembly further comprises said test button being of sufficient length to extend through the opening in the cover portion.

3. The apparatus as set forth in claim 2 wherein the cover portion, base portion, means for securing, and the test button are all an integral molded part.

4. The apparatus as set forth in claim 2 wherein the test button assembly further comprises said test button extension extending inwardly from the living hinge into the housing and a test button projection extending from the test butotn extension towards the living hinge and wherein the test button is secured to the test button projection.

5. The apparatus as set forth in claim 2 wherein the cover portion further comprises a shield portion extending outwardly about the opening through which the test button extends, said shield portion extending further from the opening than the test button such that the possibility for inadvertent contact with the test button is reduced.

6. The apparatus as set forth in claim 1 and further comprising an electrical assembly mounted between the cover portion and the base portion, such electrical assembly including switch means positioned to be contacted upon displacement of the test button.

7. An integrally molded junction assembly including electrical components, a housing and a test button, which comprises:

a cover portion and a base portion secured to each other which may be positioned to define a housing having a space therebetween in which the electrical components are secured; and a test button assembly formed integrally with the cover portion and connected thereto by a living hinge, said test button assembly including a test button being positioned to contact a switch means of the electrical components when depressed.

8. The apparatus as set forth in claim 7 wherein the test button assembly further comprises a resilient test button extension extending from the living hinge and the test button being displaceably mounted thereto.

9. The apparatus as set forth in claim 8 wherein the cover portion defines a test button opening and wherein the test button extends through the opening such that said test button may be manually displaced.

10. The apparatus as set forth in claim 9 wherein the cover portion and the test button assembly are an integral part.

11. The apparatus as set forth in claim 8 wherein the cover portion further comprises an outwardly extending shield portion extending about a projecting end of the test button to help prevent inadvertent operation of the test button.

12. The apparatus as set forth in claim 9 wherein said electrical components further comprise a clicket switch means mounted to a printed circuit board assembly and wherein said test button is positioned to engage said clicket switch means when depressed.

* * * * *